US006007034A

United States Patent [19]

Stoll et al.

[11] Patent Number: 6,007,034

[45] Date of Patent: Dec. 28, 1999

[54] DEVICE FOR THE ATTACHMENT OF A SENSOR

[75] Inventors: Kurt Stoll, Esslingen; Manfred Schütte, Ebersbach; Heidemarie Schneider, Weilheim, all of Germany

[73] Assignee: Festo AG & Co., Esslingen, Germany

[21] Appl. No.: 09/133,031

[22] Filed: Aug. 12, 1998

[30] Foreign Application Priority Data

Sep. 30, 1997 [DE] Germany ..... 297 17 492 U

[51] Int. Cl.[6] ..... A47B 96/06

[52] U.S. Cl. ..... 248/229.1; 267/32; 73/866.5; 248/550

[58] Field of Search ..... 248/229.1, 230.1, 248/223.4, 225.11, 298.1, 550, 74.1, 74.2

[56] References Cited

U.S. PATENT DOCUMENTS 5,026,255 6/1991 Carpenter et al. ..... 417/5
5,171,001 12/1992 Sawdon ..... 269/32
5,265,484 11/1993 Babbitt, II ..... 73/866.5
5,393,040 2/1995 Ueno et al. ..... 267/140.13
5,423,511 6/1995 Tekeguchi ..... 248/550
5,816,736 10/1998 Kroulik ..... 403/389

FOREIGN PATENT DOCUMENTS 41 16 651 A1 1/1992 Germany .

*Primary Examiner*—Ramon O. Ramirez
*Assistant Examiner*—Walter Landry
*Attorney, Agent, or Firm*—Hoffman & Baron, LLP

[57] ABSTRACT

An attachment device with which a sensor may be fixed to the outer periphery of a cylinder barrel of a fluid power operated drive cylinder. It comprises an attachment clamp, on which a holding face is provided for securing the sensor and cooperating with the peripheral face thereof. The holding face is formed by an undercut holding groove and provides also a working face against which a positioning element on the sensor may be engaged.

12 Claims, 1 Drawing Sheet

DEVICE FOR THE ATTACHMENT OF A SENSOR

BACKGROUND OF THE INVENTION

The invention relates to a device for the attachment of a sensor to the outer periphery of the cylinder barrel of a fluid power drive cylinder, comprising an attachment clamp made up of a clamping member adapted to at least partly fit around said cylinder barrel when said clamp is mounted thereon and of two bracing arms adjoining the ends of the clamping member and adapted to be acted upon by an associated bracing means, and holding face means for cooperation with a peripheral face of the sensor for securing same in position.

THE PRIOR ART

An attachment device of this type is disclosed in the German patent publication 4,116,651 A1. It possesses an attachment clamp, which possesses a clamping member clampingly surrounding the cylinder barrel in the mounted condition. The clamping force is produced by means of a bracing means, which draws together two bracing arms adjoining the ends of the clamping member and directed away from the cylinder barrel. The fixation in position of the sensor is performed exclusively by means of a holding face adapted to be braced against the peripheral face of the sensor, such holding face being divided up into a plurality of face sections, of which two sections are located on the two bracing arms. If the bracing means is actuated for the purpose of clamping the attachment clamp on the cylinder barrel, there is an automatic engagement with the peripheral face of the sensor by the relatively moving sections of the holding face.

A substantial disadvantage of the known attachment device is to be seen in the fact that during mounting the attachment clamp the sensor is subjected to high transverse forces. Consequently special design adaptation of the sensors is called for in order to prevent damage thereto. This is something which however involves substantial costs, more particularly since the specially adapted sensors cease to be applicable for other purposes.

In the case of a similar attachment device of the assignee there are similar problems. In the attachment clamp a hole is provided, which is open inwardly on the longitudinal side toward the cylinder barrel, the sensor, which is to be mounted, being inserted into the hole. On actuation of the bracing means the sensor is however thrust against the cylinder barrel so that again the above mentioned problems occur.

SHORT SUMMARY OF THE INVENTION

One object of the invention is to create an attachment device of the type initially mentioned which permits reliable attachment both of the attachment clamp and also of the sensor without the danger of damage for the sensor.

In order to achieve these and/or other objects appearing from the present specification, claims and drawings, in the present invention the holding face is exclusively provided on the attachment clamp, the cross section delimited by the holding face being independent of the state of actuation of the bracing means, the holding face is formed by the face of an undercut holding groove provided in the attachment clamp, such groove being closed inward on the longitudinal side toward the cylinder barrel while being open toward the outer side, turned away from the cylinder barrel, of the attachment clamp, and furthermore the holding face constitutes at least one engagement face, on which a positioning element being provided on the sensor acts in order to set the relative position of the sensor and the attachment clamp.

In this manner the attachment mechanism is decoupled from the attachment clamp and the sensor so that when fitting the attachment clamp the there is no damage to the sensor. In this manner it is possible to do without specially reinforced customized designs of sensors, and, given a suitable design of the holding groove, it is even possible to use sensors as employed in the past in connection with drive cylinders, whose cylinder barrel have pre-formed holding grooves owing to the larger overall size. The attachment device is accordingly particularly suitable for use in connection with drive cylinders of particularly small size and having a diameter of only 8 mm or 10 mm for example, which have a cylindrical barrel. A still further advantage results from the fact that there is the possibility of fine adjustment of the sensor without releasing the attachment clamp which has already been clamped in place.

Advantageous developments of the invention are defined in the dependent claims.

The holding groove serving to at least partially receive the sensor is preferably arranged on the clamping member and accordingly directly adjacent to the outer periphery of the cylinder barrel when the attachment clamp is fitted. This leads to a small radial clearance between the sensor means provided in the sensor and the actuating means for exciting same and arranged for instance on the outer periphery of the piston of the drive cylinder, such actuating means generally being constituted by an annular permanent magnet. Owing to the small radial clearance there is a high switching rate.

An arrangement which is particularly economical as regards material and space is one in which the clamping member is designed in the form of a band and at one point has a preferably integrally formed ledge in which the holding groove is provided. In this manner sufficient material will be present in order to ensure reliable attachment of the sensor, while simultaneously owing to the remaining band-like section of the clamping member there is a sufficient flexural elasticity rendering the clamping action possible.

If the ledge is formed of plastic material, there may be a metallic reinforcing rail in the ledge to ensure a secure anchoring of the sensor, and such reinforcement rail, which for example may have a U-like cross section, may be embedded during injection molding of the plastic material by having the plastic material molded around it. Anchoring ribs provided on the outer face of the ledge may serve to improve the holding function of the ledge.

An attachment clamp which is particularly advantageous as regards its shape is produced, if the ledge having the holding groove merges directly and integrally with one of the bracing arms.

In order to ensure reliable support for long sensors as well, it is possible for the ledge having the holding groove to possess a greater width as measured in the longitudinal direction of the holding groove than the remaining components of the attachment clamp and more particularly of the band-like section of the clamping member.

It is convenient for the floor surface of the holding groove to be designed as an engagement face, which is acted upon by the positioning element provided on the sensor in order to brace the sensor in the holding groove. As a positioning element it is more especially possible to use a retaining screw which is steplessly adjustable as regards the engaging force.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
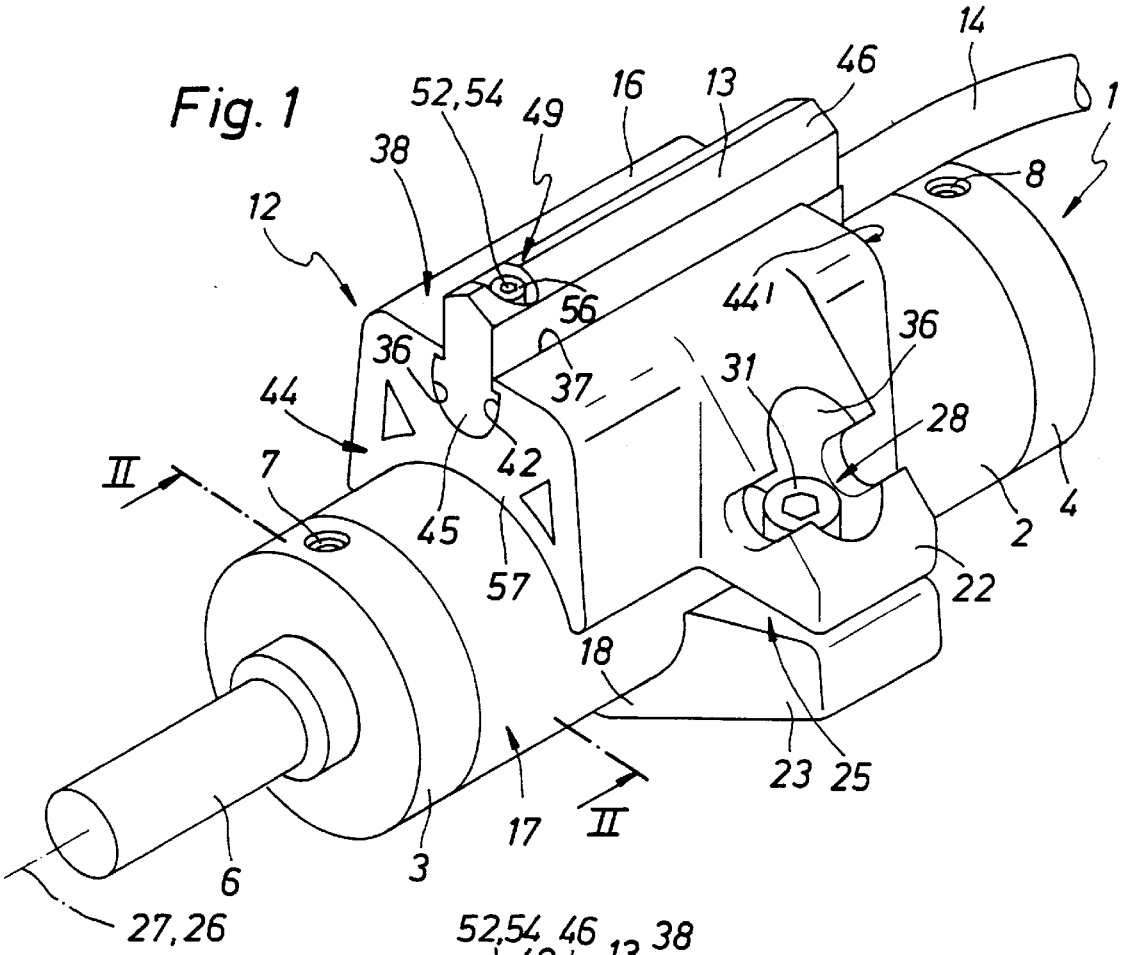
FIG. 1 is a large scale perspective elevation of a fluid power drive cylinder with an attachment means mounted thereon including a sensor held in the attachment clamp.

In the drawing the reader will see a fluid power and more particularly pneumatic drive cylinder 1 in a diagrammatic view, which has a circularly cylindrical cylinder barrel 2, which is shut off at either end by respective terminal covers 3 and 4.

In the interior of the cylinder barrel 2 an axially sliding piston 5 is located, on which a piston rod 6 is fixed, such piston rod extending axially in relation to the cylinder barrel 2 and passing through at least one of the terminal covers 3 in a sealing manner to the outside with the possibility of axial sliding motion.

At the two terminal covers 3 and 4 connection ports 7 and 8 are provided, via which an actuating fluid may be supplied and let off in order to cause the piston 5 and the piston rod 6 connected with same to move axially in the one or the other direction.

At the outer periphery of the cylinder barrel 2 a sensor 13 is arranged with the aid of an attachment device 12. Of the sensor merely the housing and a cable extending from the housing to a signal processing means, not illustrated, are shown, whereas the sensor means present in the interior of sensor are not shown, since same are prior art.

In the working embodiment the sensor means of the sensor 13 are so designed that same are responsive to a magnetic field. The sensor 13 may for example be a socalled reed switch. Actuation is caused by at least one permanent magnet actuating means 15, which in the working embodiment is formed at the outer periphery of the piston 5 as a permanent magnet. If in the course of its axial movement the piston 5 with the permanent magnet assumes a predetermined relative position radially within the sensor 13, the magnetic field will cause an actuation of the sensor means, this leading to a sensor signal, which via the electrical cable 14 or another transmission path may be passed to a processing or evaluating means.

The attachment device 12 comprises an attachment clamp 16 which is almost completely closed to form a ring, and which in the illustrated mounted state surrounds the cylinder barrel 2 on the outer periphery thereof and is firmly braced against cylindrical outer peripheral face 17 of the cylinder barrel 2.

As regards details the attachment clamp 16 comprises a clamping member 18 which in the mounted or fitted condition at least partially and preferably to a major extent encircles the cylinder barrel 2, such clamping member 18 having a respective bracing arm 22 arranged on each of its ends. The clamping member 18 delimits a clamping opening 24 with a circular cross section having the cylinder barrel 2 extending coaxially through it.

The two sensors 22 and 23 are opposite to one another in the peripheral direction as related to the clamping opening 24, the arrangement being such that when the attachment clamp 16 is seated on the cylinder barrel 2 there is a clearance 25 between the bracing arms 22 and 23.

Figure 2:
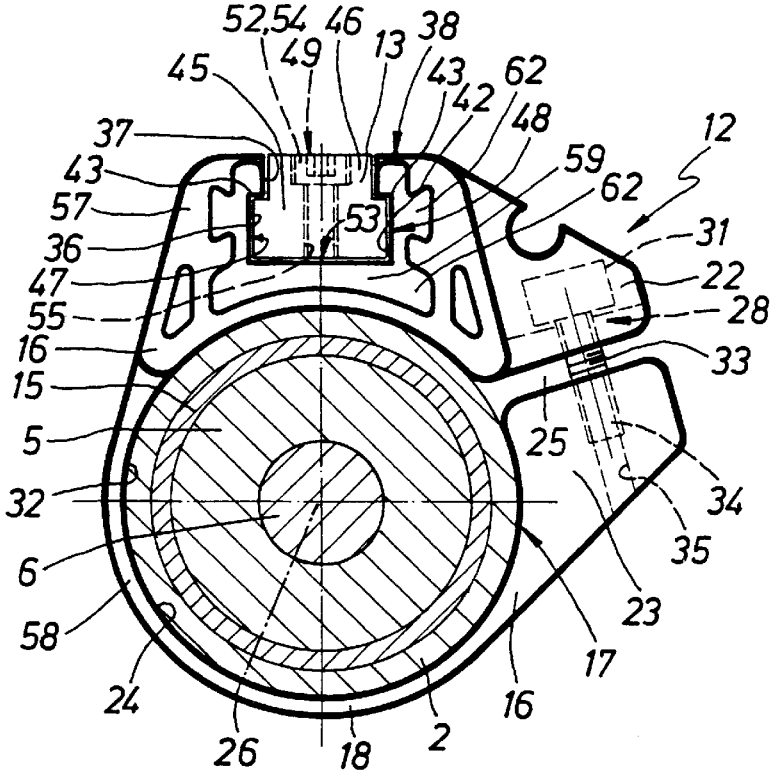
FIG. 2 shows a further embodiment of the attachment device in a cross sectional view on a section line II—II in FIG. 1.

As related to longitudinal axis 26, extending through the center of the bracing opening 24, of the clamping member 18 and coinciding with the longitudinal axis 27 of the cylinder barrel 2, the two bracing arms 22 and 23 extend radially outward so that it is readily possible to couple them with a bracing means 28 only indicated in broken lines in FIG. 2. By operation of this bracing means 28 the bracing arms 22 and 23 may be drawn together with a simultaneous reduction in the clearance 25, the flexible and more particularly flexurally elastic clamping member 18 being acted up to produce a reduction in the cross section of the clamping opening 24 and accordingly its clamping face 32, which defines the clamping opening 24 and is directed radially inward, comes into firm, frictional engagement with the outer peripheral face 17 of the cylinder barrel 2.

In the working example the bracing means 28 comprises a bracing screw 33 whose head 31 bears against one bracing arm 22, the threaded shank 34 of the screw 33 fitting into a internal screw thread 35 provided in the other bracing arm 23, such internal screw thread being in a metal insert part if the bracing arms 22 and 23 are made of plastic material.

By selection of a suitable tightening moment for the bracing screw 33 it is possible to select as needed the bracing force, with which the clamping member 18 grips the cylinder barrel 2. When the bracing screw 33 is released it is possible for the attachment clamp 16 to be shifted in relation to the cylinder barrel 2 in the longitudinal direction or to be turned in the peripheral direction in order to bring a sensor 13 mounted into some desired position. Once the desired position has been reached, the bracing screw 33 is tightened again. The head 31 of the bracing screw 33 may be let into a recess 36 in the respective bracing arm 22.

The sensor 13 is releasably held in a holding groove 36 provided in the attachment clamp 16. The longitudinal direction of this holding groove 36 extends in parallelism to the longitudinal axis 26 of the clamping member 18 and is thus in the width direction of the attachment clamp 16.

The holding groove 36 shut off on its longitudinal side inward toward the cylinder barrel 2 and accordingly toward the clamping face 32. The sole longitudinal opening remaining is the groove neck 37, which is open toward the outer side 38, directed away from the cylinder barrel 2 and, respectively, the clamping face 32, of the attachment clamp 16.

The holding groove 36 possesses an undercut cross section, because in the depth direction of the groove the groove neck 37 is adjoined by a holding section 42 which is wider than the neck 37, the transition of the two longitudinal sides being defined by a respective step 43.

At the end the holding groove 36 is open toward either end and opens toward the associated side face 44 and 44' of the attachment clamp 16.

The sensor 13 to be fixed in place in the holding groove 36 possesses an anchoring section 45 with an external shape complementary to the holding section 42. For fitting in place the sensor 13 is inserted into the holding groove 36 from the end, the anchoring section 45 moving into the holding section 42 and hooking onto the two steps 43.

A further sensor section 46 adjoining the anchoring section 45 may, as shown in FIG. 2, extend into or, as shown in FIG. 1, through the groove neck 37, the sensor assuming a position in which its entire height is completely within the holding groove 36 (FIG. 2) or in which it projects outward past the internal face 38 of the attachment clamp 16 (FIG. 1).

The shape of the sensor 13 is preferably so adapted to the outer shape of the holding groove 36 that the sensor may be shifted in the longitudinal direction in relation to the holding groove 36 with only a little force, if it is not additionally secured in place. In this case the holding face 47 formed by the groove face—this being the face defining the holding groove 36—cooperates in a supporting manner with the peripheral face 48, located in the holding groove 36, of the sensor, the sensor 13 preferably being supported and fixed at least essentially in all directions with the exception of the longitudinal direction of the holding groove 36.

This leads to the advantage that the holding face 47 for the sensor 13 is exclusively provided on the attachment clamp 16 so that the groove cross section delimited by the holding face 47 is independent of the state of actuation of the bracing means 28. On tightening or releasing the bracing means 28 there is consequently neither a widening nor a narrowing of the groove s cross section so that the sensor 13 is not subjected to any possible damaging forces.

In order to set the axial position of the sensor 13 in relation to the attachment clamp 16 there is the provision of a positioning means, generally referenced 49, on the sensor 13. It comprises at least one positioning element 52 which bears against the sensor 13 and by actuation may be pre-braced against an engagement face 53, such face 53 being constituted by the holding face 47 within the holding groove 36.

In the illustrated working examples the working face 53 is constituted by the floor face of the holding groove 36, which in the case of FIG. 2 is flat or even and in the case of FIG. 1 is curved. As a positioning element a retaining screw 54 is for instance provided, which runs in a screw threaded hole 55 extending through the sensor 13 in the vertical direction and which may be screwed by applying a wrench to the screw head 56 arranged on the top side of the sensor 13. By screwing in the retaining screw 54 toward the groove floor the end of the threaded shank of the retaining screw 54 is thrust against the groove floor constituting the engagement face 53 so that the anchoring section 45 is thrust upward in the opposite direction and braced against the two steps 43. Accordingly the sensor 13 is frictionally and releasably held in the holding groove 36 so that it cannot be shifted in the axial direction.

There is therefore the possibility of fine adjustment of the axial sensor position after fixing the attachment clamp 16 by relative positioning of the sensor 13 in relation to the attachment clamp 16. The two clamping mechanisms operate completely separately from each other.

There is furthermore the possibility of employing sensors in connection with a cylinder barrel having a round external shape as same are already used in connection with drive cylinders, which on the outer periphery of the cylinder barrel, which is normally square in shape, have integrally formed attachment grooves. There is then no longer any need to stock different sensors as has so far be a cause of costs and complexity.

It is preferred for the holding groove 36 as in the examples to be provided on the clamping member 18 of the attachment clamp 16. More particularly it is possible for the clamping member to be like a clamp or band and to have a preferably integral ledge 57 at one point along the periphery of the clamping opening 24, such ledge projecting outwardly radially. In the band-like section 58 of the clamping member 18 with a greater thickness of the material, the holding groove 36 may be well integrated as illustrated. However owing to the thin, band-like section 58 there is sufficient flexibility for bending to provide the desired clamping effect on the cylinder barrel 2.

It is convenient for the holding groove 36 to directly merge with the one bracing arms 22, an integral design being recommended.

FIG. 1 furthermore indicates that in the longitudinal direction of the holding groove 36 the ledge may readily have a larger width than the remaining components of the attachment clamp 16. In the case of the illustrated working embodiment the band-like section 58 and the bracing arms 22 and 23 are each made narrower than the ledge 57, which projects axially at either end. It would also be feasible for the ledge 57 on one axial side to be flush with the other components of the attachment clamp 16 and if necessary to extend it correspondingly to the other side. In any case the ledge 57 does offer the opportunity of having a relatively long holding groove 36 so that the sensor 13 is laterally supported reliably at least for a major part of its length.

In the illustrated working embodiment in accordance with FIG. 1 the clamping member 18 including the ledge 57 and the bracing arms 2 and 23 are manufactured integrally of plastic material. The holding groove 36 is molded directly in the plastic material of the ledge 57.

FIG. 2 shows a somewhat different design in which the ledge 57 consisting of plastic material has a metallic reinforcement rail 59 embedded therein, which defines the holding groove 36. It preferably possesses a U-like cross section, the trough thereof having an internal shape corresponding to the desired groove form, whereas the external form is unimportant. However it is to be recommended to provide one or more longitudinally extending anchoring ribs 62 so that there is an undercut into which the plastic material of the ledge fits to hold it. In this manner there is a particularly reliable interlocking anchoring effect in the depth direction of the holding groove 36.

The integration of the reinforcement rail 59 is best ensured directly during manufacture of the attachment clamp 16 in the course of an injection molding operation. In this case it is possible for the reinforcement rail 59 to be placed in the injection mold to have the material molded around it so that it is covered over on all sides apart from the holding groove and the ledge.

In order not to affect the actuation of the sensor 13 it is best to employ a non-ferromagnetic material as for example aluminum as a material for the reinforcement rail 59.

We claim:

1. A device for the attachment of a sensor to the outer periphery of the cylinder barrel of a fluid power drive cylinder, comprising an attachment clamp made up of a clamping member adapted to at least partly fit around said cylinder barrel when said clamp is mounted thereon and of two bracing arms adjoining the ends of the clamping member and adapted to be acted upon by an associated bracing means, and holding face means for cooperation with a peripheral face of the sensor for securing same in position, the holding face is exclusively provided on the attachment clamp, the cross section delimited by the holding face being independent of the state of actuation of the bracing means, the holding face is formed by the face of an undercut holding groove provided in the attachment clamp, such groove being closed inward on the longitudinal side toward the cylinder barrel while being open toward the outer side, turned away from the cylinder barrel, of the attachment clamp, and furthermore the holding face constitutes at least one engagement face, on which a positioning means being provided on the sensor acts in order to set the relative position of the sensor and the attachment clamp.

2. The attachment device as set forth in claim 1, wherein the holding groove is provided on said clamping member.

3. The attachment device as set forth in claim 2, wherein the clamping member is designed in the form of a band and at one point has a preferably integrally formed ledge in which the holding groove is provided.

4. The attachment device as set forth in claim 3, wherein the ledge is formed of plastic material, and has a metallic reinforcing rail, more particularly with a U-like cross section, embedded in it, said rail defining the holding groove.

5. The attachment device as set forth in claim 4, wherein said reinforcement rail comprises non-ferromagnetic material and more particularly aluminum material.

6. The attachment device as set forth in claim 4, wherein the reinforcement rail with the exception of the recess defining the holding groove is enclosed peripherally in the plastic material of the ledge.

7. The attachment device as set forth in claim 4, wherein the reinforcement rail possesses anchoring ribs embedded in the plastic material of the ledge in an interlocking fashion.

8. The attachment device as set forth in claim 3, wherein the ledge having the holding groove merges directly and integrally with one of the bracing arms.

9. The attachment device as set forth in claim 3, wherein the ledge having the holding groove has a larger width than the band-like section of the clamping member.

10. The attachment device as set forth in claim 1, wherein the clamping member and the bracing arms are manufactured as integral plastic bodies.

11. The attachment device as set forth in claim 1, wherein the engagement face is constituted by the floor face of the holding groove against which it is able to be braced by means of a retaining screw serving as a positioning means and bearing against the sensor.

12. The attachment device as set forth in claim 1, wherein the clamping opening surrounded by the clamping member possesses a circular cross section.

* * * * *